United States Patent [19]

Scheffey, Sr.

[11] Patent Number: 5,037,324

[45] Date of Patent: Aug. 6, 1991

[54] PLUG AND SOCKET RETAINER

[76] Inventor: Donald G. Scheffey, Sr., 2607 Faust Rd., Gilbertsville, Pa. 19525

[21] Appl. No.: 561,919

[22] Filed: Aug. 2, 1990

[51] Int. Cl.[5] ..... H01R 13/58

[52] U.S. Cl. ..... 439/452; 439/367

[58] Field of Search ..... 439/599, 600, 601, 367, 439/368, 369, 370, 371, 299, 300, 350, 452

[56] References Cited

U.S. PATENT DOCUMENTS

| | | | |
|---|---|---|---|
| 2,903,669 | 9/1959 | Gilman et al. | 439/369 |
| 3,014,194 | 12/1961 | Berglund | 339/75 |
| 3,030,601 | 4/1962 | Krebs | 439/369 |
| 3,059,209 | 10/1962 | Bird | 339/75 |
| 3,750,084 | 7/1973 | Gardner | 439/253 |
| 3,781,761 | 12/1973 | Harwood | 339/75 |
| 3,922,055 | 11/1975 | McGregor | 339/105 |
| 3,999,828 | 12/1976 | Howell | 439/369 |
| 4,475,649 | 10/1984 | Haarbosch | 439/367 |
| 4,784,612 | 11/1988 | Ryan | 439/369 |
| 4,946,398 | 8/1990 | Takenouchi | 439/599 |

*Primary Examiner*—David L. Pirlot

*Attorney, Agent, or Firm*—Eckert Seamans Cherin & Mellott

[57] ABSTRACT

A retainer prevents the accidental separation of mating plug and socket connectors on electrical cords, or protects the connectors from inadvertent unsafe use. The retainer includes a housing which is open at one end and has a slit running along its length. An electrical cord is inserted into the slit, and the housing is moved along the cord so that the connectors enter the housing through the open end. The slit can be spiral and/or helical to reduce the possibility of the cord inadvertently coming free. A cover also having such a slit is placed on the other electrical cord and moved toward the open end of the housing. Interfitting structures removably secure the cover to the housing, thereby preventing separation of the plug and socket connectors. The interfitting structures can be arranged to engage at any point along a length span. In addition to use as a tension resisting cover for a plug and socket junction, when the housing is placed on the cord and a cover lacking an electrical cord is attached to the cover, a user must remove the cover for access and cannot inadvertently use a cord thereby marked as unsafe.

19 Claims, 2 Drawing Sheets

PLUG AND SOCKET RETAINER

BACKGROUND OF THE INVENTION

1. Field of the Invention

The invention relates to the field of devices for supportively engaging the mating ends of electrical wires and the like. The invention maintains connection of the ends of mating electrical cord connectors by engaging each of the connectable ends of the electrical cords in one of two interfitting removably connectable support elements. The elements can receive a cord laterally and engage the cord behind an enlarged plug or socket portion at the cord end. The invention relates particularly to a device for preventing accidental separation of the plug and socket ends of joined electrical cords due to tension along the connected ends, and is also useful as a means to mark a particular socket or plug end as unavailable for use.

2. Prior Art

When operating an electrical device, it is often necessary to use one or more electrical extension cords connected in series in order to allow operation of the device at a desired distance away from an electrical outlet. This is especially true when using electrically powered hand tools, electrical lawn and garden tools, and the like. The electrical cords are joined together using standard plug and socket ends. Normally, the plug is retained in the socket by friction, and there is no positive locking mechanism to prevent separation of the plug and socket ends. Also, the plug may only fit loosely in the socket due to wear or damage to one of the members. As the user moves the electrical device during operation, tension is created between the connected electrical cords, for example due to one of the cords becoming snagged, or due to the user reaching the end of the length defined by the connected cords. In using a tool connected by serially plugged cords, without paying undue attention to the cord, users often partially or totally withdraw the plug from the socket by inadvertently placing sufficient tension on the connection. Electrical power to the device may become intermittent or totally lost. At a minimum, the operator is inconvenienced in having to discontinue use of the tools, retrace the cord to find the parted junction of the plug and socket, reconnect the cord ends, and return to the tool. Time is lost from the job. The operator may be frustrated and angered by such an occurrence, particularly if this disruption occurs repeatedly. In some instances a safely hazard may result.

Devices are known for preventing the inadvertent separation of electrical cords by providing a protective body having an internal cavity for housing a connected plug and socket, ends of the body defining abutments which are rigidly positioned at a space from one another, and bear the tension applied to the cord by engaging behind the plug and socket from opposite directions U.S Pat. No. 3,014,194—Berglund discloses such a cable connector protector wherein a waterproof and dirtproof housing has a laterally open longitudinal passage through which two cable ends can be inserted, the cable ends being sealingly engaged and the passage being sealed as well. An elongated flexible slide covers the passage along its length and is releasably engaged to prevent withdrawal of the cable ends from the housing. The passage simply defines a laterally opening channel, covered by the slide.

U.S. Pat. No. 4,475,649—Haarbosch discloses a storage case for enclosing a connected plug and socket, wherein the case can be defined by a hingeable box with openings for the cable at opposite ends. In one embodiment the box defines a cylinder wherein opposite sides do not hinge but rather remain rigid. A radial wedge shaped opening is defined in the cylinder, leading to the openings for the cable at each opposite end. This cylindrical box is simply passed laterally over the connected cable ends until the cables reside in the end openings. It is relatively easy to disengage the box from the cable at one or both ends, because the wedge shaped opening defines a substantially open path allowing the cable and box to become relatively displaced.

U.S. Pat. No. 3,059,209—Bird discloses a terminal protector wherein a housing has a longitudinal slit as disclosed by Berglund and in Haarbosch. The Bird device further has a plurality of circumferential interior ribs which are adapted to engage the circumferential periphery of inserted connectors. The lateral opening in the Bird device is somewhat smaller than the cord, requiring that the housing be resiliently deformed in order to move the cable through the opening into position.

The Berglund and Bird devices, while presumably effective in preventing separation of the connectors, are somewhat difficult to use. Relatively widened connector ends must be inserted through a relatively narrow slit. Although the slit width can be expanded by pulling apart the flexible sides of the housing, the arrangement presents a difficulty for the user. Also, in order to disconnect the cords, the reverse procedure must be followed. Conversely, with a wedge shaped lateral opening as in Haarbosch or the like, there is little to prevent the cable from escaping from the protective housing.

U.S. Pat. No. 3,781,761—Harwood discloses a different type of plug and socket retainer. The retainer comprises a strip of flexible material with spaced apertures along the edges of the strip. Joined electrical cords can be inserted into the apertures in an alternating fashion. Tension on the cords is resisted by the flexible strip. U.S. Pat. No. 3,922,055—McGregor discloses a retainer comprising a metal rod in a coiled arrangement. Cords inserted into the coils from each end of the device are joined at the midsection.

The Harwood and McGregor devices also have some drawbacks. The electrical cords are not positively held in these retainers and can become loose from the retainers and disengaged from one another. Further, these retainers do not provide protection against damage to the connectors, and on the contrary tend to expose the cords leading to the connectors to damage by causing them to protrude laterally and to define potential obstructions which may cause the plug and socket to become disconnected notwithstanding the resistance to tension.

The present invention provides a retainer for electrical cord connectors by means of a housing which engages the connector ends, extending at least part way over the plug and socket when connected. The housing has a larger opening at one end, providing access to the ends of the plug or socket. The other end of the housing has a smaller opening which is large enough to accommodate the cord, but too small to allow the plug or socket to pass longitudinally out of the housing. A laterally extending slit runs radially outward from the smaller opening and along one side of the housing, to an edge of the larger opening, allowing lateral insertion of an electrical cord into the housing, to position the cord such that tension tending to pull the cord relative to the housing is borne on the inner surface of the housing adjacent the smaller opening. The slit is preferably arranged in a nonlinear path proceeding from the aperture to the outside, which reduces the possibility that the cord can inadvertently pass through the slit as a result of contact between the housing and/or cover and various obstructions encountered in the regular use. Preferably, the slit defines a spiral or helical configuration having a width which snugly engages the cord, preferably such that the slit resiliently engages the cord. Both the resilient engagement and the configuration of the slit tend to keep the cord from escaping from the housing.

The connector of a cord inserted into the housing through the lateral slit may be joined to the mating connector of a second cord. Both connectors are accessible in the housing through the end having the larger opening. A cover, also provided with a lateral slit allowing a cord to be inserted laterally into position, engages with the housing and captures the mated plug and socket on opposite ends of the junction. Tension applied across the junction of the cords is born by the inner surfaces of the housing (at the smaller opening end) and the cover, the latter having a corresponding smaller opening dimensioned to encompass the cord while blocking passage of the somewhat larger plug or socket structure. The cover is removably attachable to the housing over the open end to provide an enclosure for longitudinally capturing the mated connectors. Any tension imparted to the cords is absorbed at the cover and housing attachment points, thus preventing inadvertent separation of the connectors. Preferably, the cover is attached to the housing via longitudinal leg members on at least one of the housing and the cover, engageable with the other of the housing and the cover. The leg members have serrations or the like by which the cover can be fixed to the housing at any point in a range of distances from the end wall of the housing.

The invention is described with reference to capturing the mating ends of two connectors. The same structure is also useful for blocking access to a connector which is engaged in the housing and covered, because the housing clearly marks the connector end and the cover blocks inadvertent access from outside the housing. Therefore, by housing and covering the unconnected free ends of a cord, a worker operating on a disconnected circuit or the like can cover the end of a cord connected to the circuit and be relatively assured that another person will not inadvertently connect a hot electrical cord thereto, with possible shock danger to the worker.

SUMMARY OF THE INVENTION

It is an object of the invention to provide a retainer for physically capturing the mating connectors of joined electrical cords against separation due to tension.

It is another object of the invention to provide a retainer for electrical connectors which is simple and easy to use.

It is a further object of the invention to provide a retainer for electrical connectors which prevents damage to the connectors.

It is still another object of the invention to provide a retainer for electrical connectors, the retainer being separable into components which may remain attached to mating electrical cords after the cords have been disconnected.

It is yet another object of the invention to provide a means to block access to the unconnected plug or socket on the free end of an electrical cord, to mark the cord against inadvertent use.

These and other objects are accomplished by a retainer that prevents the accidental separation of mating plug and socket connectors on electrical cords, or protects the connectors from inadvertent unsafe use. The retainer comprises a housing which is open at one end and has a slit running along its length. An electrical cord is inserted into the slit, and the housing is moved along the cord so that the connectors enter the housing through the open end. A cover having a slit is placed on the other electrical cord and moved toward the open end of the housing. Interfitting structures removably secure the cover to the housing, thereby preventing separation of the plug and socket connectors. Alternatively, when the housing is placed on the cord and a cover lacking an electrical cord is attached to the cover, a user must remove the cover for access and cannot inadvertently use a cord marked as unsafe.

BRIEF DESCRIPTION OF THE DRAWINGS

There are shown in the drawings the embodiments of the invention as presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
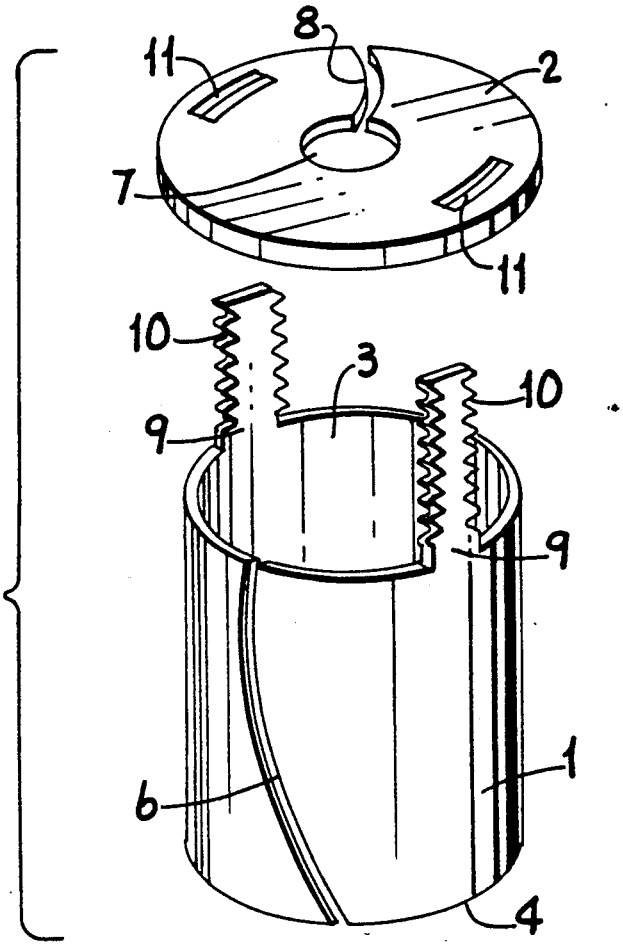
FIG. 1 is a perspective view of a retainer according to the invention, shown disassembled.
Figure 2:
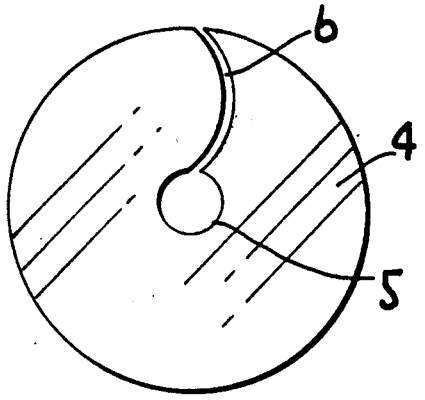
FIG. 2 is a bottom view of a retainer housing shown in FIG. 1.

A plug and socket retainer according to the invention as shown in FIGS. 1 and 2 comprises a housing 1 and a cover 2, which can engage one another over the plug and/or socket ends of electrical cables. In the embodiment shown the housing portion substantially defines the cavity in which the plug and socket of the connected cords resides. This arrangement is convenient in that the cover portion can be substantially a flat disk with appropriate apertures therein, as discussed herein. It is also possible to arrange the device such that the cover and the housing are both cup shaped, provided the distance between the apertured endwalls of the cavity defined by the housing and the cover are close enough than tension on the plug and socket connection cannot part them.

The housing 1 in the embodiment shown has an open end 3, an opposite end 4 defining an endwall, and a housing aperture 5 in the endwall. The housing aperture is at least as large as the cable whose socket will reside in the housing, and preferably the aperture dimensions are substantially equal to those of the cable. the cable can be round in cross section, flattened or otherwise formed, with the aperture shaped accordingly. Alternatively, the aperture can be substantially round and of a diameter equal to the largest dimension of the cable cross section. The plug or socket on the end of the cable is larger than the cable, and as a result, the end wall retains the housing on the plug or socket against tension in the direction of the endwall.

The housing has a slit 6 which defines a lateral opening between the housing aperture 5 and the outside, through which the cable can be passed, such that it is not necessary to thread the cover all the way down a cable to the plug or socket bearing end. The slit preferably runs helically along a side of the housing 1 starting from the open end 3 and then spirally inward at the endwall, terminating in the housing aperture 5. A helical and/or spiral slit as described is nonlinear and nonradial, and accordingly a lateral (radial) force on the cord causes the cord to bear against the side of the slit such that the cord cannot readily escape. The slit can be of approximately equal width as the cable, or slightly smaller such that the housing must be deformed slightly in order to pass the cable from the aperture 5 to the outside, or vice versa. The housing material can then be resilient enough to permit such deformation, making it relatively easy to pass the cable manually back and forth, but also preventing the cable from being inadvertently passed through the slit by contact between the housing and/or cover and various obstructions in the area where the cable is used.

The housing 1 preferably has interior dimensions suitable for receiving any of various standard mating plug and socket connectors, with the aperture large enough to accommodate the range of cord widths and small enough to prevent passage of the smallest plug or socket. When the housing is in place on an end of a cable, tension between the cable (or more particularly the socket or plug thereon) and the housing is opposed by engagement of the plug or socket against the endwall of the housing.

The cover 2 engages the opposed plug or socket on a cord to be mated with the cord whose plug or socket is disposed in the housing. The cover attaches to the housing such that a space for the two mated connectors (plug and socket) is defined between the plug and socket. As a result, tension between the connected cords is borne by the cover and housing and does not tend to part the plug and socket. The cover has an aperture 7, comparable to aperture 5 in cover 1. A cover slit 8 runs laterally of the aperture 7 between an edge of the cover 2 and the aperture 7 in the cover.

Figure 4:
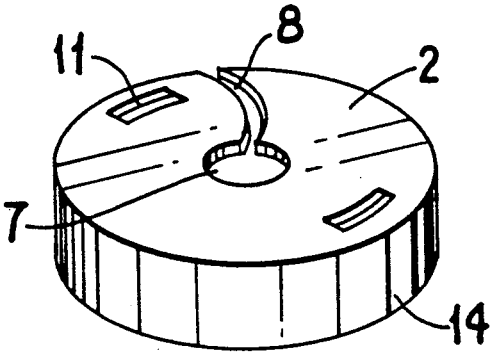
FIG. 4 is a perspective view of a cover having sides.

The housing 1 and the cover 2 are preferably made of a resilient material. the housing and/or cover can define a cross-section which is cylindrical, square, or any other suitable shape of adequate internal dimension to accommodate the plug and socket. The cover 2 can be cup shaped in the same manner as the housing, but preferably is flat and engages with the housing by means of mating connection elements defining a length adjustable fitting of the cover and the housing. It is also possible to form the cover with attached sides 14 to form a cup shape as in FIG. 4.

The resilient material of the housing 1 and cover 2 preferably allows expansion of the housing slit 6 and cover slit 8 for passage of an electrical cord laterally inwardly from the outside to the aperture 5 or 7. The aperture is preferably central in the cover 1 or in the endwall of the housing. Alternatively, housing slit 6 and cover slit 8 each can have a width sufficient to allow free passage of an electrical cord, for example in an embodiment wherein the housing and/or cover material is too rigid to readily permit deformation. In any event, housing aperture 5 and cover aperture 7 are dimensioned to receive an electrical cord therein while preventing a plug or socket connector from pulling through.

Securing means are provided for removably securing the cover 2 to the housing 1. In a preferred embodiment the securing means includes at least one arm, extending from the housing 1 at the open end 3, and engaging with the cover at least at one point along the length of arm 9. Preferably, two such arms 9 are provided, opposite one another on the open end 3 of the housing. The arms 9, as shown, can have serrations 10 along their edges, defining a plurality of points at which the cover and the housing can be fixed, thereby accommodating plug and socket connections anywhere in the length range thus provided. The cover 2 has slots 11 located and dimensioned for removably receiving arms 9 along serrations 10, the serrations having maximum and minimum widths such that the maximum widths must be forced resiliently through the openings in the cover.

It is likewise possible to provide arms on the cover, and means such as a flange having openings complementary with the arms, on the housing. In either case, the cover and the housing can be fixed together to enclose a connected plug and socket between abutments defined by the cover and the endwall of the housing.

Figure 3:
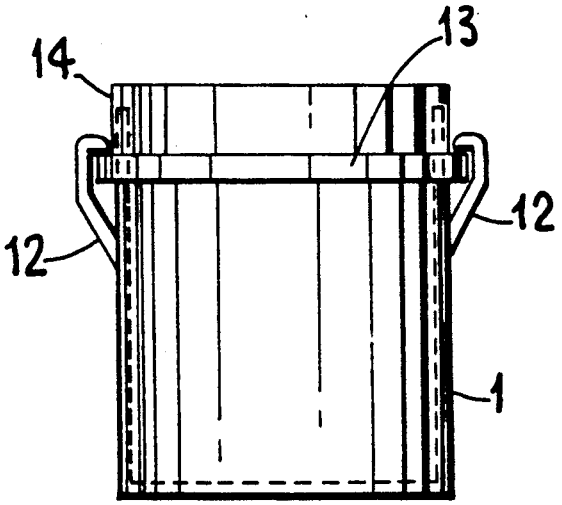
FIG. 3 is a side view of a retainer having clips for securing a cover.

In an alternative embodiment, the securing means comprise clips 12 attached to housing 1 as shown in FIG. 3. Cover 2 on sides 8 has a ridge 13 disposed at least part way around the circumference thereof on the outer surface of sides 14. Clips 12 on housing 1 are resilient and define clasping surfaces at their distal ends which may be spread from their rest position against housing 1 in order to receive and engage ridge 13 of cover 2.

A description of the use of the plug and socket retainer of the invention is as follows. Two electrical cords preferably are initially joined by inserting the plug of one cord into the socket of the other cord. The housing is aligned with one of the cords such that open end 3 is towards the plug and socket connectors. The cord is passed laterally through housing slit 6 until it is disposed in housing aperture 5. Housing 1 is then moved axially along the cord to bring housing 1 over the connectors. The other cord is passed through cover slit 8 until the cord is contained in cover aperture 7. Cover 2 is then moved into position at the open end 3 of housing 1 to be fastened by the securing means. The securing means prevents separation of cover 2 from housing 1, and thus prevents the plug and socket connectors from becoming accidentally disconnected. It is also possible to initially attach the housing and/or cover to the plug and socket, i.e., before attaching together the plug and socket.

When it is desired to separate the plug and socket connectors, the securing means is released and the housing 1 and the cover 2 are withdrawn along their respective electrical cords. The housing 1 and the cover 2 may be removed from the cords in a reverse of the installation process, namely by passing the cord laterally through the preferably-spiral slit running between the respective aperture and the outside of the housing and cover. The housing 1 and the cover 2 may remain on the electrical cords after the plug and socket are disconnected. The housing 1 and the cover 2 will not readily become detached and potentially lost, and remain readily available for use upon subsequent use of the electrical cords.

The housing and cover are useful for marking the unconnected end of a plug or socket against its inadvertent use. The housing on a plug or socket end of a cord can be enclosed under the cover without first attaching the cover to the mating cord. In this manner, the plug or socket is enclosed and the conscious effort of removing the cover is needed before the plug or socket can be used. In the event a worker is occupied with repair work on a circuit, the cover can prevent another person from connecting power to the covered circuit by mistaking the cord for one that is intended to be used.

A number of additional possibilities for the order of connections are possible. As noted herein, the connection means can be disposed in either or both male/-female senses on the housing and cover. With reference to the embodiment with arms 9, for example, the housing can have one or a plurality of arms 9 engageable in corresponding openings in the cover. Alternatively, the cover can have the arms and the openings can be in the housing, e.g., in a flange adjacent the open end, or even in the endwall including aperture 5. As a further possibility, each of the housing and the cover can have both at least one arm and an opening for receiving an arm on the other of the housing and the cover.

In the embodiment shown, the housing is cup shaped and the cover is substantially flat. The housing can be molded in a complete single piece, or can be formed by die cutting from sheet material, followed by attachment steps, for example to close the sheet material of the endwall into a cylindrical shape as shown. The housing can likewise be square in cross section or can be another shape, and can be formed in a similar manner. The material of the housing can be resilient plastic, for example vinyl, polyvinyl chloride, or similar material. In the event the arms 9 are provided on the housing, the hover can be a relatively more rigid material than the housing. It is not strictly necessary that both be formed of resilient material, but only that the arms and the corresponding openings be engageable in the manner described.

The invention having been disclosed, a number of variations within the scope of the invention will now become apparent to persons skilled in the art. Reference should be made to the appended claims rather than the foregoing specification in order to assess the scope of the invention in which exclusive rights are claimed.

I claim:

1. A retainer for removably engaging electrical plugs and sockets defining an enlargement at an end of an electrical cord, comprising:

a housing dimensioned to encompass at least part of an electrical connector defining one of a plug and a socket, said housing having a first end with a relatively larger opening permitting access to an end of said electrical connector, and an opposite end having a wall with a relatively smaller opening, the relatively smaller opening being at least as large as the cord and smaller than a maximum width of the electrical connector, the housing having a slit running laterally from the smaller opening and along a side of the housing to said first end, whereby the cord can be laterally inserted into the housing to reside in the smaller opening;

a cover having means to removably attach to the housing at a distance from the wall sufficient to encompass a connected plug and socket between the cover and the wall, the cover having an aperture at least as large as the cord and smaller than a maximum width of the electrical connector, the cover having a slit running laterally from a peripheral edge of the cover to said aperture, whereby the cord can be laterally inserted to reside in said aperture;

at least one of the slits in the housing and in the cover defining a nonlinear and nonradial path leading from the smaller opening and the aperture, respectively, to the outside, whereby a force tending to displace the cord laterally of the retainer causes the cord to bear against a side of said at least one of the slits, restricting the cord from passing readily to the outside.

2. The electrical plug and socket retainer as defined in claim 1, wherein said nonlinear and nonradial path is at least partly a spiral path as viewed along a longitudinal axis of the cord.

3. The electrical plug and socket retainer as defined in claim 1, wherein said nonlinear and nonradial path is at least partly a helix.

4. The electrical plug and socket retainer as defined in claim 1, wherein at least one of said housing and said cover is substantially round in cross-section.

5. The electrical plug and socket retainer as defined in claim 1, wherein said cover is substantially flat.

6. The electrical plug and socket retainer as defined in claim 1, wherein said cover is cup-shaped.

7. The electrical plug and socket retainer as defined in claim 1, wherein at least one of said housing and said cover is made of a resilient material.

8. The electrical plug and socket retainer as defined in claim 7, wherein at least one of said slits is resiliently expansible, whereby at least one of the housing and the cover must be deformed from a rest position in order to pass the cord from the relatively smaller opening to outside the retainer.

9. The electrical plug and socket retainer as defined in claim 7 wherein said securing means includes an arm on at least one of the housing and the cover engageable with a slot in the other of the housing and the cover, the arm having at least one variation defining a dimension greater than a dimension of the slot, the arm being resiliently forcible through the slot to secure the housing and the cover.

10. The electrical plug and socket retainer as defined in claim 7, wherein said securing means comprises a plurality of arms extending from at least one of said housing and said cover, each of the arms being engageable by means disposed in the other of said housing and said cover.

11. The electrical plug and socket retainer as defined in claim 7, wherein said securing means comprises at least one arm extending from at least one of said housing and said cover, the arm having serrations along at least a part thereof, and a slot in the other of said housing and said cover, dimensioned to engage the serrations.

12. The electrical plug and socket retainer as defined in claim 7, wherein said securing means comprises at least one clip attached to one of said housing and said cover, and a circumferential ridge disposed on the other of said housing and said cover for engaging with the clip.

13. A retainer for an electrical cord having an enlarged plug, comprising:

a housing having lateral walls and an end, the end having an aperture smaller than the plug and larger than the cord, the housing having a slit through which the cord can be laterally inserted to reside in said aperture with the plug substantially enclosed by said lateral walls, the slit in the housing defining a nonlinear and nonradial path leading from the aperture, through the end and along the lateral walls to open outside the housing, whereby a force tending to displace the cord laterally of the retainer causes the cord to bear against a side of the slit, restricting the cord from readily escaping from the retainer.

14. The retainer of claim 13, wherein the housing is open opposite said end and further comprising a cover for the housing, removably attachable to the housing opposite said end.

15. The retainer of claim 14, wherein the cover also has an aperture for receiving an electrical cord and a slit leading from the aperture to an edge of the cover.

16. The retainer of claim 15, wherein the slit in the cover is nonlinear and nonradial, whereby a force tending to displace the cord laterally of the cover causes the cord to bear against a side of the slit, restricting the cord from readily escaping from the retainer.

17. The retainer of claim 16, wherein the slit in the cover includes a spiral part as viewed along a longitudinal axis of the cord.

18. The retainer of claim 13, wherein the slit in the housing includes a spiral part as viewed along a longitudinal axis of the cord.

19. The retainer of claim 18, wherein the slit includes a helical part along said lateral walls of the housing.

* * * * *